US005226568A

United States Patent [19]

Newton et al.

[11] Patent Number: 5,226,568

[45] Date of Patent: Jul. 13, 1993

[54] FLEXIBLE CONTAINER FOR STORAGE AND DISPENSING OF STERILE SOLUTIONS

[75] Inventors: Roger E. Newton, Teaneck, N.J.; Melvin D. Walters, Iowa City, Iowa

[73] Assignee: Blairex Laboratories Inc., Evansville, Ind.

[21] Appl. No.: 820,220

[22] Filed: Jan. 13, 1992

[51] Int. Cl.[5] ..... B05B 11/04

[52] U.S. Cl. ..... 222/212; 222/494

[58] Field of Search ..... 222/212, 213, 490–494

[56] References Cited

U.S. PATENT DOCUMENTS

| | | | |
|---|---|---|---|
| 1,911,616 | 5/1933 | Gruber . | |
| 1,987,156 | 1/1935 | Papapello . | |
| 2,025,810 | 12/1935 | Dinnes . | |
| 2,128,035 | 8/1938 | Boetel . | |
| 2,556,571 | 6/1951 | Bobbs et al. . | |
| 2,628,004 | 2/1953 | Schlicksupp | 222/493 |
| 2,785,841 | 3/1957 | Westgate . | |
| 2,974,835 | 3/1961 | Herbrick | 222/507 |
| 3,160,329 | 12/1964 | Radic et al. | 222/494 X |
| 3,220,618 | 11/1965 | Lodding et al. . | |
| 3,321,114 | 5/1967 | Croyle . | |
| 3,527,551 | 9/1970 | Kutik et al. . | |
| 3,602,407 | 8/1971 | Grothoff . | |
| 4,061,254 | 12/1977 | Nilson | 222/494 |
| 4,099,651 | 7/1978 | von Winckelmann . | |
| 4,112,971 | 9/1978 | Nilson . | |
| 4,141,474 | 2/1979 | Nilson . | |
| 4,141,475 | 2/1979 | Nilson | 222/493 |
| 4,253,588 | 3/1981 | Lester et al. . | |
| 4,349,134 | 9/1982 | Schuster et al. | 222/212 |
| 4,474,314 | 10/1984 | Roggenburg, Jr. | 222/494 |
| 4,506,809 | 3/1985 | Corsette | 222/213 |
| 4,516,530 | 5/1985 | Schmidt . | |
| 4,699,300 | 10/1987 | Blake | 222/494 |
| 4,739,906 | 4/1988 | LoTurco | 222/494 X |
| 4,785,978 | 11/1988 | Kano et al. | 222/494 X |
| 5,033,647 | 7/1991 | Smith et al. | 222/494 X |
| 5,115,950 | 5/1992 | Rohr | 222/494 X |

FOREIGN PATENT DOCUMENTS

| | | |
|---|---|---|
| 0109728 | 5/1984 | European Pat. Off. . |
| 0172711 | 2/1986 | European Pat. Off. . |
| 1586697 | 6/1967 | Fed. Rep. of Germany . |
| 2362346 | 6/1974 | Fed. Rep. of Germany . |
| 1157573 | 7/1969 | United Kingdom . |
| 2106480 | 4/1983 | United Kingdom . |
| 8200128 | 1/1982 | World Int. Prop. O. . |

*Primary Examiner*—Andres Kashnikow
*Assistant Examiner*—Kenneth DeRosa
*Attorney, Agent, or Firm*—Woodard, Emhardt, Naughton, Moriarty & McNett

[57] ABSTRACT

A plastic squeeze container for dispensing an appropriate solution is disclosed. The top of the container includes a cone-shaped portion which serves as a stem or core for a valve assembly which includes an elastomeric seal which overlies and resiliently grips and circumferentially seals around the stem. The seal also covers an aperture in the container top adjacent the stem. A small central aperture in the seal where it overlies the closing of the stem, enables dispensing contents from the container when the container is squeezed, as the resulting internal pressure causes the seal to balloon slightly away from the stem and permit passage of the solution from the container through the container aperture and through the seal central aperture. When the external pressure is removed, the seal resiliently retracts against the stem and closes the container. A screw-on cap is also provided which when attached to the container creates a seal which isolates the aperture at the top of the container and prevents unintentional dispensing of container contents due to accidental squeezing of the container. Finally, the valve assembly includes a peripheral seal which prevents air from leaking in.

8 Claims, 3 Drawing Sheets

FLEXIBLE CONTAINER FOR STORAGE AND DISPENSING OF STERILE SOLUTIONS

BACKGROUND OF THE INVENTION

This invention relates generally to dispensing containers, and more particularly to a container for storing and controlled dispensing of sterile solutions.

A normal procedure for the user of contact lenses is to periodically remove the lenses and clean them. For this purpose, a sterile saline solution is normally used. In order to avoid contamination of the solution by bacteria before use, it is important to keep the solution from coming into contact with the air during storage, or to include a preservative in the solution. The problem with the use of preservatives in the solution is that, since the lenses are not dry when inserted in the eye, some solution remains on the lenses and the preservative in the solution can irritate the eyes.

One answer to the problem has been to eliminate the preservative from the lens cleaning solution and provide a container that prevents the stored solution from coming into contact with the air. In other words, provide a container that allows fluid to leave the container but prevents air from being sucked back into the container to contaminate the unused solution. One such container is disclosed in U.S. Pat. No. 4,739,906 by LoTurco issued on Apr. 26, 1988. LoTurco discloses a plastic squeeze container having a one-way valve that permits fluid to be squeezed out of the container but the one-way valve prevents air from penetrating back from the valve into the solution to contaminate it. The Loturco container also includes a cap which presses against the valve, further preventing air from penetrating into the container via the one-way valve. But there remains a desire for a container having the advantages of the LoTurco container with reliability in a wider range of sizes, even down to a very small size.

An object of the present invention is to provide an improved storage and dispensing device which can dispense droplets or a slow stream of an appropriate solution, and which will not permit air contact with the undispensed portion of the solution or trapped dispensed solution that could be exposed to bacteria in the air. A further object of the invention is to provide an improved device which is self-closing once the solution has been dispensed.

SUMMARY OF THE INVENTION

A self-closing container assembly for the controlled dispensing of fluid comprising a cylindrically shaped plastic container having a uniquely shaped neck and top portion. The top portion includes a cone-shaped valve stem which serves as a core of a valve assembly that includes an elastomeric seal, which overlies the cone. An aperture in the container top near the cone but under the seal enables dispensing contents from the container through a small central aperture in the seal where it overlies the cone. In the absence of internal pressure in the container, the seal resiliently retracts against the cone and closes the container. The container assembly also includes a retainer ring which holds the valve assembly onto the container and includes another air-tight seal around the periphery of the container top preventing air from leaking between the various mating surfaces joining the pieces of the valve assembly together. Finally, a screw-on cap is provided which includes still another air-tight seal positioned between the cone valve and the outer periphery seal which serves to prevent air from being sucked back in through the valve during long-term storage.

DESCRIPTION OF THE PREFERRED EMBODIMENT

Figure 1:
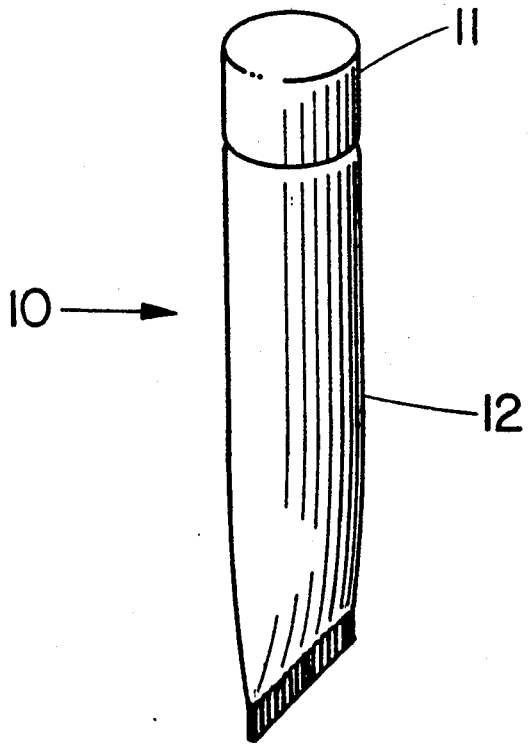
FIG. 1 is a pictorial view of a container assembly according to a typical embodiment of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
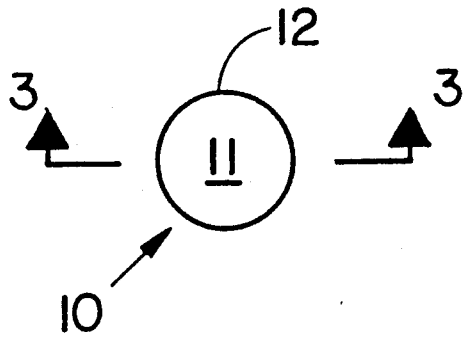
FIG. 2 is a top plan view thereof.
Figure 4:
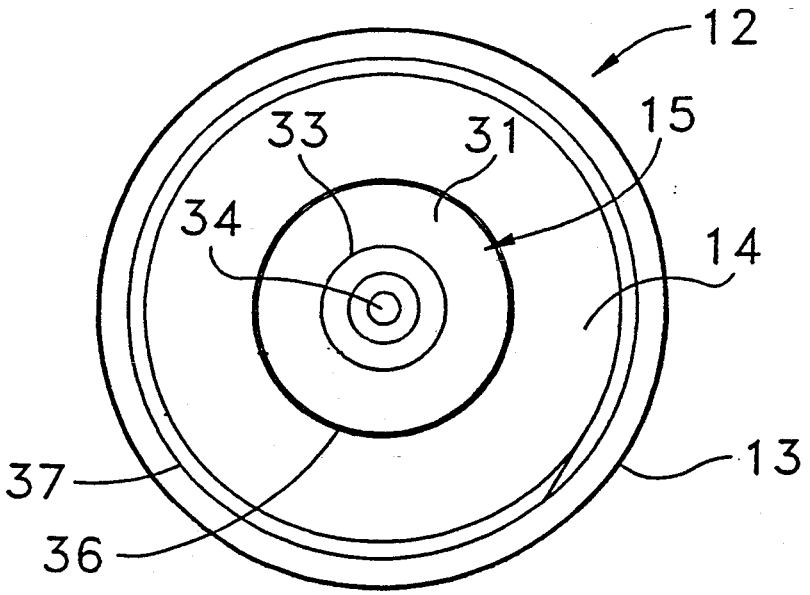
FIG. 4 is an enlarged top plan view of the container assembly with the cap removed.

Referring now to the drawings, there is shown in FIGS. 1 and 2 a storage container 10 for contact lens cleaning solution. Storage container 10 includes container assembly 12 and cap 11, and is shown in the preferred size, which is a container having a height of less than 4 inches and a diameter less than 1 inch. The preferred size is convenient for its ease of storage and ability to be readily carried away from the home and used practically anywhere. Storage container 10 is normally filled with 99% sterile saline solution and then hermetically sealed at the factory, and then sterilized by gamma radiation.

Figure 3:
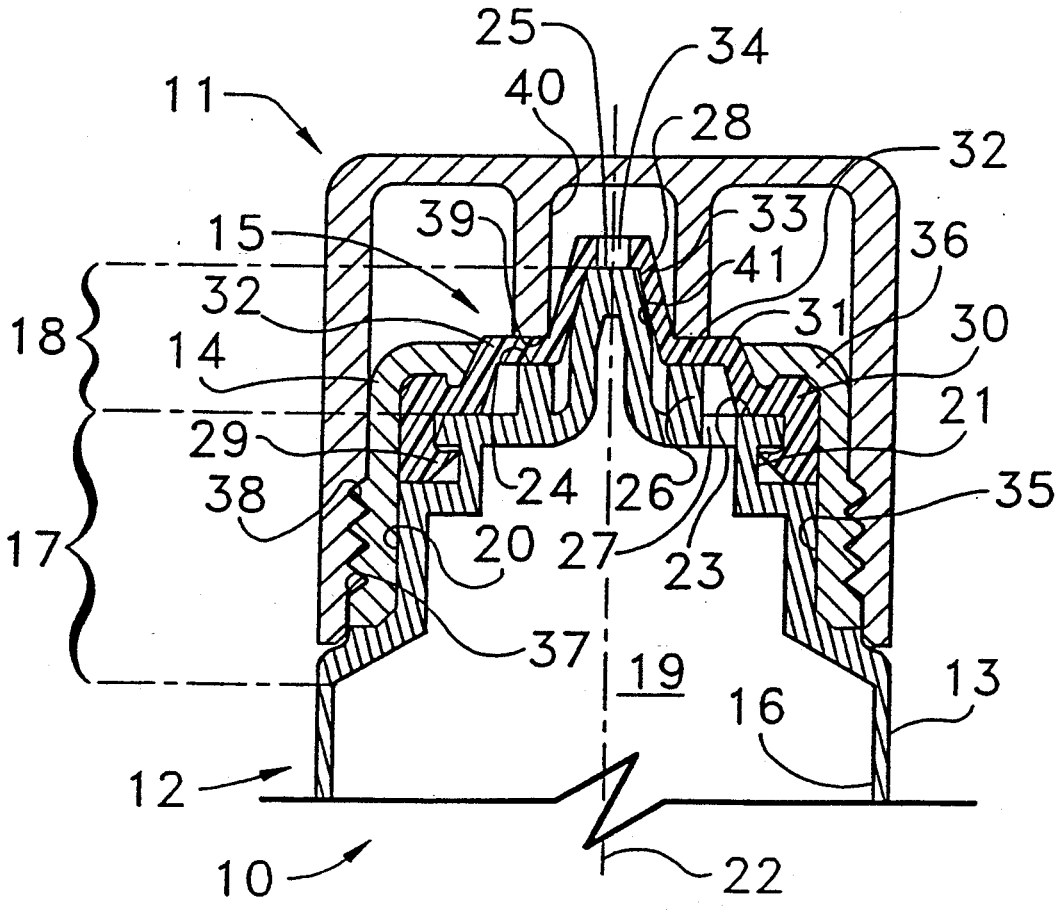
FIG. 3 is a fragmentary longitudinal section through the container assembly of FIG. 2, the section being taken on the plane containing the axis of the container assembly along section line 3—3 in FIG. 2 and viewed in the direction of the arrows.

Referring now to FIG. 3, there is shown a close-up section view of the top portion of the storage container 10. Again, storage container 10 includes container assembly 12 and cap 11. Container assembly 12 includes vessel 13, retaining ring 14, and resiliently pliable valve closure 15. Vessel 13 can be considered to comprise three distinct portions, namely: a resiliently deformable body portion 16, a neck portion 17 and a head portion 18. Vessel 13 is formed of molded plastic, with the walls of body portion 16 being relatively thin to permit deformation while the walls of the neck and head portion are made relatively thick to resist deformation. Vessel 13 defines an inner cavity 19 for holding the stored contact lens cleaning solution. The neck portion 17 of vessel 13 has a cylindrically shaped attachment surface 20 and an annular retaining groove 21 which opens radially outward relative to the central axis 22. The head portion 18 of vessel 13 includes a first sealing surface 23, a second sealing surface 24, a valve stem 25 and an outlet opening 27 positioned between first sealing surface 23 and second sealing surface 24. Valve stem 25 projects upwardly away from the container and includes a tapered portion 28, which acts as a valve seat.

Resiliently pliable valve closure 15 is mounted atop and over the head portion of the vessel. Valve closure 15 is preferably formed of a soft supple membrane type of material having an elastomeric nature. An example of such a product is marketed as (Krayton D No. 2109-2026-0), white, by Shell Chemical Company and approved by the FDA. Various other elastomers may be used. Valve closure 15 includes an inwardly projecting annular flange 29 which is sized to be received into the annular retaining groove 21. The resilient nature of valve closure 15 allows annular flange 29 to be deformed and mated with annular retaining groove 21. Valve closure 15 also includes a first sealing portion 30, a diaphragm portion 31 and a nozzle member 33. Valve closure 15 is permanently attached to vessel 13 by retaining ring 14. Retaining ring 14 includes an opposing attachment surface 35 which is ultrasonically welded in a conventional manner known in the art to attachment surface 20 of vessel 13. In so doing, flange 36 of retaining ring 14 and first sealing surface 23 of vessel 13 pinch first sealing portion 30 therebetween forming an annular fluid-tight seal around the periphery of the valve assembly. This peripheral seal prevents leakage of fluid out of the container between the mating surfaces and also prevents the entrance of air into the container between the same mating surfaces which are located at the contact points between the retaining ring 14, the valve closure 15 and the vessel 13.

Valve closure 15 also includes a nozzle member 33 formed in the shape of a cone having an inner surface 41 and a discharge outlet 34 formed on the top of the cone. The cone portion of nozzle member 33 preferably has a half-angle of approximately 15 degrees from the central axis 22. Tapered portion 28 of valve stem 25 is shaped to be substantially similar to the inner surface 41 of valve member 33. Because of the elastomeric nature of valve closure 15, the inner surface 41 of nozzle member 33 circumferentially grips the tapered portion 28 of the valve stem preventing fluid flow through the discharge outlet 34 when in its closed configuration as shown in FIG. 3.

Head portion 18 of vessel 13 also includes a second seal surface 24 which is actually the upper rim of a cylindrical projection 26. Diaphragm portion 31 of valve closure 15 normally rests against sealing surface 24 when the container is in a closed position as shown. However, when the cap 11 is attached to the container assembly 12 as shown, a portion 32 of diaphragm 31 is pinched between sealing surface 24 and ring seal surface 39 which is disposed on the rim of cylindrically shaped projection 40 formed on the underside of cap 11. When cap 11 is threadedly secured to the container assembly 12, via the threads 38 on the cap mating with threads 37 on the annular retaining ring 14, diaphragm portion 32 is pinched between ring seal surface 39 and sealing surface 24 forming a second fluid-tight seal around the base of nozzle member 33. Thus, when cap 11 is secured to container assembly 12, outlet opening 27 is trapped between two annular seals and isolated from the valve closure at the center of the container assembly. In this way, the container is securely sealed without disturbing the relationship between the nozzle member 33 and valve stem 25.

Figure 5:
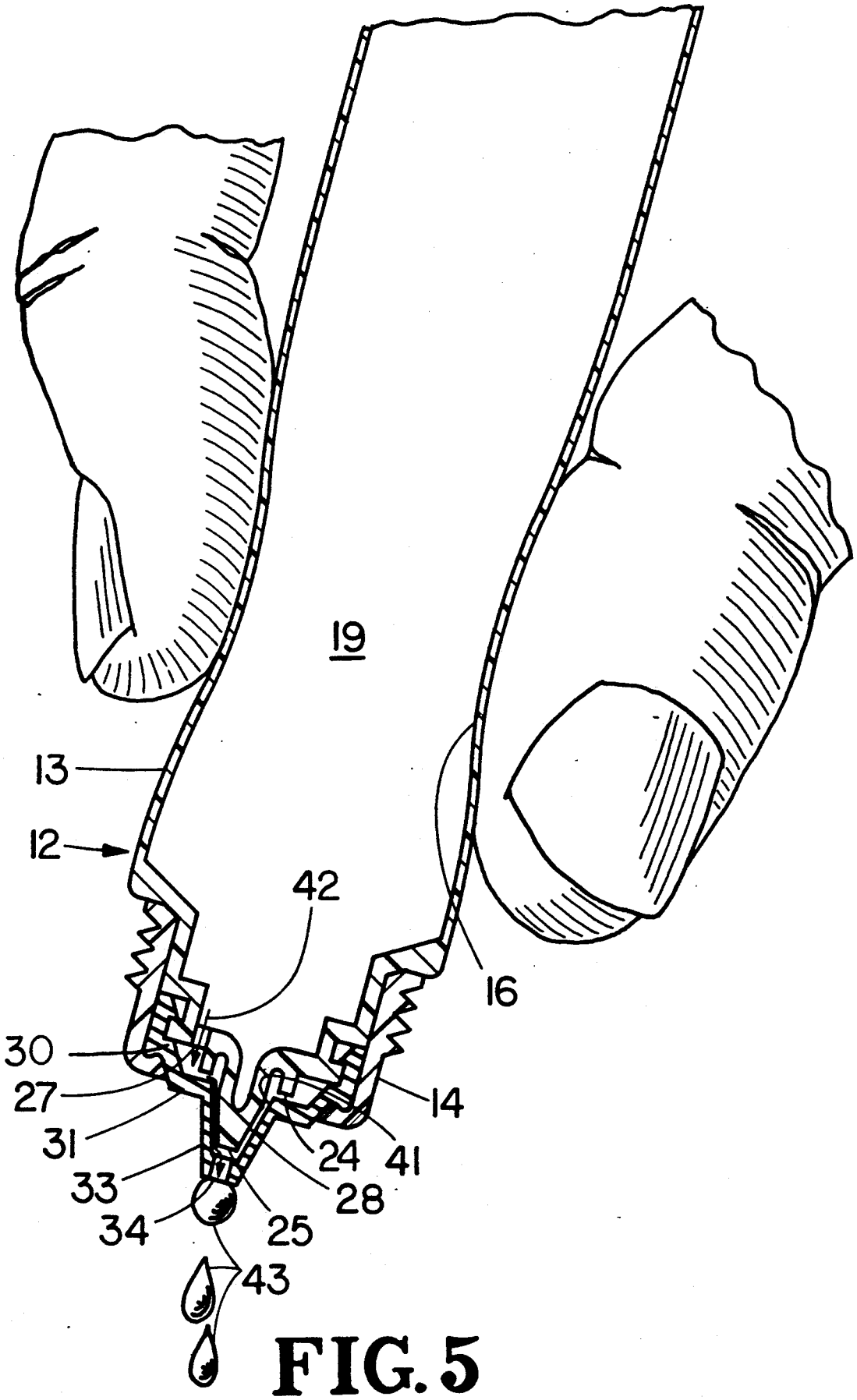
FIG. 5 is a fragmentary longitudinal section of the container assembly according to a typical embodiment of the present invention and being squeezed to dispense contact lens cleaning solution from the container.

Referring now to FIG. 5, the container assembly 12 is shown in the dispensing condition with the cap removed. When the body portion 16 of vessel 13 is deformed as shown, the pressure within cavity 19 rises. When enough external pressure is applied, the pressure within cavity 19 will rise sufficiently to overcome the circumferential grip between the nozzle member 33 and the tapered portion 28 of valve stem 25, thus allowing fluid to flow from within the container through outlet 27 past diaphragm 31 and out discharge outlet 34. This flow path is shown by arrows 42 in FIG. 5. When external pressure is removed from the container, the inner surface 41 of nozzle member 33 reseats against the tapered portion 28 of valve stem 25 preventing air from being sucked back into the container. The flow rate out of the container along flow path 42 is proportional to the amount of external pressure applied to the container assembly, thus allowing the user to dispense the contact lens cleaning solution in a drop-by-drop fashion 43 as shown in FIG. 5 or, with more pressure, to permit a steady stream to flow out the discharge outlet 34. The separation distance between the valve closure 15 and the vessel 13 permitting the fluid to flow is shown exaggerated for purposes of illustration. In actuality, the separation spaces are quite small and possibly unobservable by an unaided eye. In essence, the pressure created within cavity 19 causes the unrestrained portion of the valve closure to balloon away from the top of the container permitting fluid to flow between the surfaces that are normally in contact with the top of the container.

Although the body 16 is deformable to dispense the fluid contents of the container, the memory of the container material tends to restore the container to its original configuration after deformation. Like most plastic containers which are deformed as a result of dispensing a portion of their contents, the container assembly of the present invention tends to want to suck air back into the container in order to replace the lost volume from the dispensed solution and permit the container to return to its original shape. However, this resumption of shape is prevented because the nozzle member 33 immediately forms a fluid-tight seal with the valve stem 28 when the external pressure is removed. Thus, the body 16, once deformed, is unable to return to its original cylindrical configuration. If there were no valve on the top of the container, air would be sucked back into the container to replace the volume of lost solution which was dispensed from the container. In other words, when the external pressure is removed from the container after deformation, the pressure within cavity 19 remains lower than the ambient pressure surrounding the container due to the shape memory tendency of the container material. Leakage is further prevented during storage when the cap is attached, forming another fluid-tight seal at the base of the nozzle as shown in FIG. 3.

For the purposes of example only, and not by way of limitation, the size of outlet opening 27 is 0.020 to 0.060 inches. That for discharge outlet 34 is 0.040 to 0.080 inches. The diameter of the container is approximately 0.5 to 3.0 inches and the height of the container with the cap attached is approximately 3 to 9 inches. The typical wall thickness of the body portion 16 of vessel 13 is on the order of 0.0075 to 0.022 inches.

While various polyolefins can be used for these parts, here are some examples of suitable materials. Vessel 13 can be molded from low density polyethylene material manufactured by DuPont No. LDPE 2020T in a white opaque color, as approved by the FDA. The head and neck portions are molded in one piece of low density polyethylene 70/30 blend of Rexene PE700CS20 and Petrothane LS404. The neck is heat fused to the vessel 13. The retaining ring 14 can be formed of the same blend as the head and neck. The cap may be an injection molded polypropylene such as Lyondell PP51B12A.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-closing flexible container assembly for the controlled dispensing of fluid, comprising:

a container having a deformable body, a neck portion and a head portion, said body defining a cylindrical shape having a central axis before deformation and having a cylindrical cavity therein of a known volume but capable of being deformed such that said volume of said cylindrical cavity is reduced, said neck portion having a first cylindrically shaped attachment surface adjacent said body, said head portion having a first sealing surface, a second sealing surface, a valve stem and at least one outlet opening to said cylindrical cavity positioned between said first sealing surface and said second sealing surface, said valve stem including a tapered portion projecting away from said body;

a resiliently pliable valve closure having a sealing flange, a first seal portion, a diaphragm and a nozzle member, said first seal portion being aligned with said first sealing surface of said head portion, said nozzle member having an inner surface and defining a discharge outlet, said inner surface being seated in immediate contact with and elastically gripping said tapered portion of said valve stem when in a closed position to produce a first fluid-tight seal but being capable of ballooning outwardly away from said tapered portion when enough fluid pressure is applied to said inner surface thereby allowing fluid to escape via said discharge outlet, said valve closure resiliently returning to said closed position when the fluid pressure is relieved; and a retaining ring having an opposing attachment surface and a sealing flange, said opposing attachment surface being attached to said first attachment surface of said neck portion, said first seal portion of said valve closure being pinched between said first sealing surface and said sealing flange forming a second fluid-tight seal;

whereby after said body has been deformed to dispense a portion of the stored fluid within the container, said first fluid-tight seal and said second fluid tight seal prevent ambient air from entering said container thus preventing contamination of the remaining fluid stored within the container;

the container assembly further comprising a cap defining a cap cavity sized to substantially cover said neck and said head portion of said container, said cap including a threaded portion;

said retaining ring further including an opposing threaded portion projecting radially outward from said central axis for threadedly engaging said threaded portion of said cap; and said cap including a ring seal surface disposed within said cap cavity in opposition to said second sealing surface of said head portion, a portion of said diaphragm being pinched between said ring seal surface and said second sealing surface to produce a third fluid-tight seal when said cap is secured onto the container.

2. The self-closing container assembly of claim 1 wherein:

said ring seal surface is a rim of a cylindrically shaped first projection formed on said cap within said cap cavity, said projection substantially enclosing said nozzle member when said cap is secured onto the container.

3. The self-closing container assembly of claim 2 wherein;

said second sealing surface is a rim of a cylindrically shaped second projection formed as part of said head portion, said second projection surrounding a portion of said valve stem.

4. The self-closing container assembly of claim 3 wherein;

said opposing attachment surface of said retaining ring is ultrasonically welded to said first cylindrically shaped attachment surface of said neck portion.

5. The self-closing container assembly of claim 4 wherein;

said body is formed of a resilient material such that said body would tend to resume said cylindrical shape after deformation if ambient air were allowed to be sucked back into said container;

whereby said first fluid-tight seal and said second fluid-tight seal prevent ambient air from being sucked back into said container thus preventing said body from resuming said cylindrical shape after deformation to dispense a portion of the fluid stored within said container.

6. The self-closing container assembly of claim 5 wherein;

said body of the container has a diameter of 0.5 inch to 3.0 inches.

7. The self-closing container assembly of claim 6 wherein;

the container assembly is 3 to 9 inches tall when said cap is secured onto the container.

8. The self-closing container assembly of claim 7 wherein;

the container is substantially filled with sterile saline solution.

* * * * *